US006761665B2

(12) United States Patent
Nguyen

(10) Patent No.: US 6,761,665 B2
(45) Date of Patent: Jul. 13, 2004

(54) MULTI-FUNCTION EXERCISE APPARATUS

(76) Inventor: Hieu Trong Nguyen, 14219 SE. Oak St., Portland, OR (US) 97233

( * ) Notice: Subject to any disclaimer, the term of this patent is extended or adjusted under 35 U.S.C. 154(b) by 343 days.

(21) Appl. No.: 10/017,228

(22) Filed: Dec. 7, 2001

(65) Prior Publication Data

US 2002/0123412 A1 Sep. 5, 2002

(51) Int. Cl.[7] ..... A63B 22/04; A63B 22/00
(52) U.S. Cl. ..... 482/51; 482/71; 482/52
(58) Field of Search ..... 482/51–53, 57, 482/70, 71, 79–80; 601/27, 33–35

(56) References Cited

U.S. PATENT DOCUMENTS

| | | | | |
|---|---|---|---|---|
| 4,720,093 | A | | 1/1988 | Del Mar |
| 4,733,858 | A | * | 3/1988 | Lan ..... 482/53 |
| 5,033,733 | A | | 7/1991 | Findlay |
| 5,135,447 | A | | 8/1992 | Robards, Jr. et al. |
| 5,180,351 | A | * | 1/1993 | Ehrenfried ..... 482/52 |
| 5,203,751 | A | | 4/1993 | Chang |
| 5,290,211 | A | | 3/1994 | Stearn |
| 5,421,798 | A | | 6/1995 | Bond et al. |
| 5,536,225 | A | | 7/1996 | Neuberg et al. |
| 5,595,554 | A | | 1/1997 | Maresh |
| 5,792,027 | A | * | 8/1998 | Gvoich ..... 482/51 |
| 5,792,029 | A | | 8/1998 | Gordon |
| 5,836,854 | A | | 11/1998 | Kuo |
| 5,839,995 | A | | 11/1998 | Cehn |
| 5,876,307 | A | | 3/1999 | Stearns et al. |
| 5,879,271 | A | | 3/1999 | Stearns et al. |
| 5,882,281 | A | | 3/1999 | Stearns et al. |
| 5,910,072 | A | * | 6/1999 | Rawls et al. ..... 482/51 |
| 6,036,622 | A | * | 3/2000 | Gordon ..... 482/51 |
| 6,045,488 | A | | 4/2000 | Eschenbach |
| 6,083,397 | A | * | 7/2000 | Cox ..... 210/620 |
| 6,126,573 | A | | 10/2000 | Eschenbach |
| 6,152,859 | A | | 11/2000 | Stearns |
| 6,183,397 | B1 | | 2/2001 | Stearn |
| 6,183,398 | B1 | | 2/2001 | Rufino et al. |
| 6,196,948 | B1 | | 3/2001 | Stearns et al. |
| 6,203,474 | B1 | | 3/2001 | Jones |
| 6,302,830 | B1 | | 10/2001 | Stearns |
| 6,368,252 | B1 | | 4/2002 | Stearns |
| 6,398,695 | B2 | | 6/2002 | Miller |
| 2001/0012811 | A1 | | 8/2001 | Gordon |
| 2001/0016541 | A1 | | 8/2001 | Maresh et al. |
| 2001/0023219 | A1 | | 9/2001 | Arnold et al. |

OTHER PUBLICATIONS

U.S. patent application Ser. No. 09/798,502, Nguyen, filed Nov. 13, 2000.

* cited by examiner

*Primary Examiner*—Stephen R. Crow
(74) *Attorney, Agent, or Firm*—Kolisch Hartwell, P.C.

(57) ABSTRACT

A multi-function exercise apparatus includes a frame, left and right pedal guides, left and right foot pedals and left and right handles. The left and right pedal guides are constrained to pivot back and forth reciprocally, and the left and right foot pedals are constrained to slide reciprocally along the pedal guides. Additionally, the apparatus may include resistance subsystems configured to selectively apply a resistance force against the pivot motion of the pedal guides and the radial motion of the foot pedals along the length of the pedal guides. The left and right handles are coupled to the left and right pedal guides for upper body exercise.

20 Claims, 4 Drawing Sheets

MULTI-FUNCTION EXERCISE APPARATUS

TECHNICAL FIELD

The present invention relates generally to a multi-function exercise device, and more particularly to an exercise device wherein the exerciser may perform a variety of different leg exercise motions.

BACKGROUND OF THE INVENTION

Over the years, a variety of exercise devices have been produced to facilitate lower body exercise. These exercise devices are configured to allow an exerciser to perform repetitively a limited and invariable exercise motion. For example, treadmills enable a person to run or walk; stair-climbers enable a person to simulate climbing; skiing machines enable a person to stride in place; elliptical trainers enable a person to walk or run through an elliptical path.

Unfortunately, these exercise devices have certain drawbacks. First, by limiting a user to a specific exercise, these exercise devices develop only a specific muscle group. This may result in an unbalanced workout for the user. Second, repetitive motion may cause premature muscle fatigue for the targeted muscle group, resulting in a shorter period of exercise, or injuries such as stress fractures, tendon and ligament damage, muscle pulls, etc. Third, these exercise devices limit the user to repeating only a certain exercise motion and over time may become boring and unchallenging to the user.

It is therefore the object of the present invention to provide an exercise apparatus that enables a user to perform lower body exercise with a variety of exercise motions, thereby increasing the effectiveness and challenge of the exercise apparatus.

SUMMARY OF THE INVENTION

An exercise apparatus is provided. Typically the exercise apparatus includes a frame, left and right pedal guides which are pivotally mounted to the frame, and left and right foot pedals which are configured to slide in a radial direction along the pedal guides. The apparatus may further include a radial motion translation linkage configured to link the foot pedals reciprocally in the radial direction along the length of each pedal guide, and a pivot translation linkage configured to link the pivot motion of the pedal guides reciprocally. Additionally, the apparatus may include a pivot resistance subsystem configured to selectively apply a resistance force against the pivotal motion of the pedal guides, and a radial resistance subsystem configured to selectively apply a resistance force against the radial motion of the foot pedals. The apparatus may also include left and right handles which are selectively coupled to left and right pedal guides, respectively, to provide upper body exercise.

The pivot resistance subsystem may selectively lock the pedal guides from pivoting back and forth, thereby constraining the foot pedals to move up and down in a stair-stepping mode. The radial resistance subsystem may selectively lock the foot pedals from sliding along the pedal guides, thereby constraining the foot pedals from movement in a radial direction along the guides and enabling the foot pedals to pivot back and forth in a striding mode. The resistance subsystems may apply a selective resistance force against the foot pedal movement and allow the user to move her feet through a variety of paths at the discretion of the user.

DETAILED DESCRIPTION OF THE INVENTION

Figure 2:
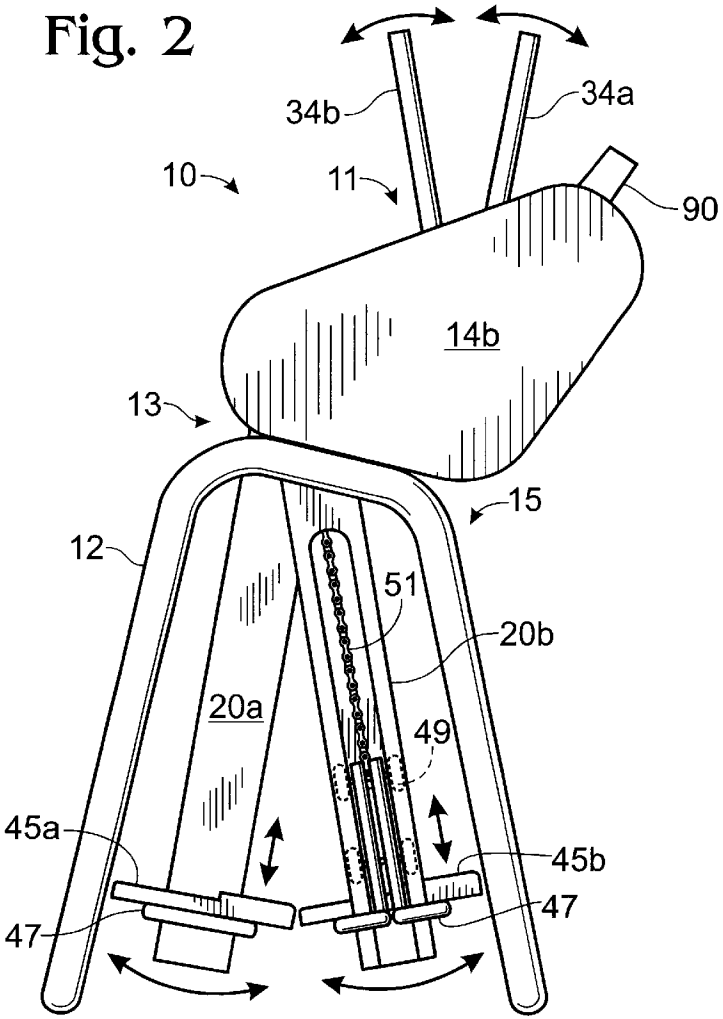
FIG. 2 is a side view of the exercise apparatus of FIG. 1.
Figure 1:
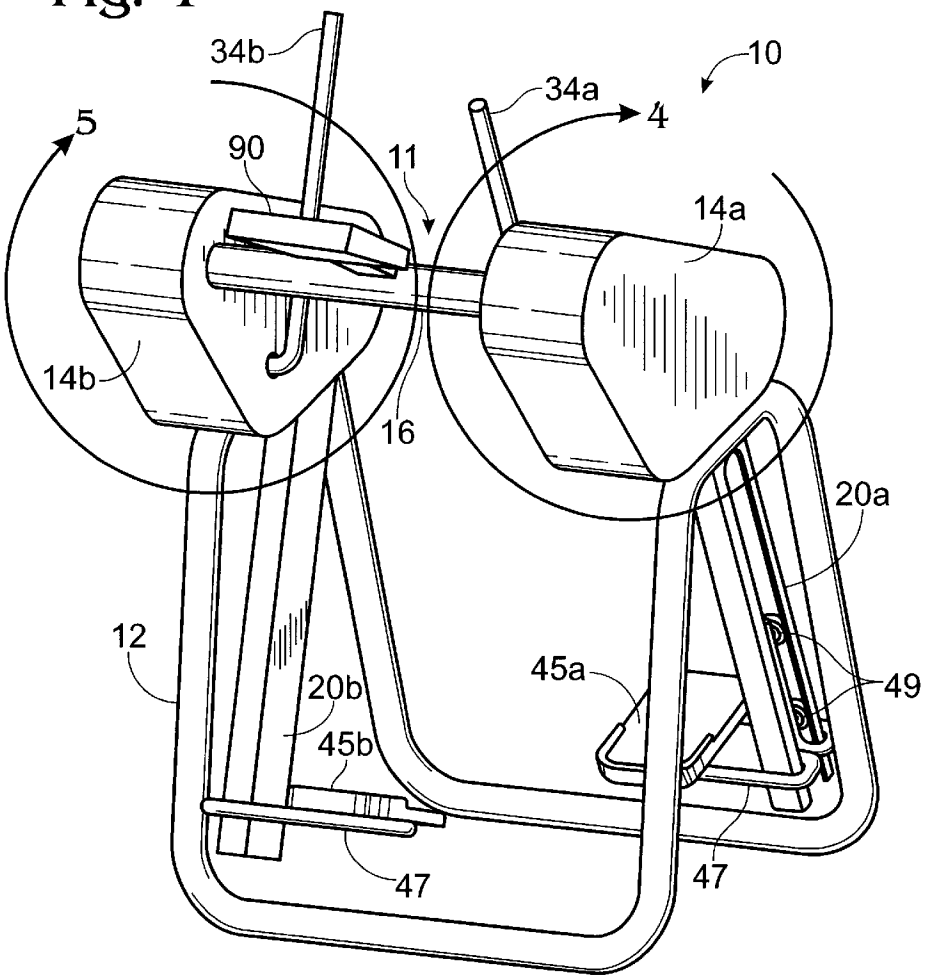
FIG. 1 is a perspective view of an exercise apparatus according to one embodiment of the present invention.
Figure 3:
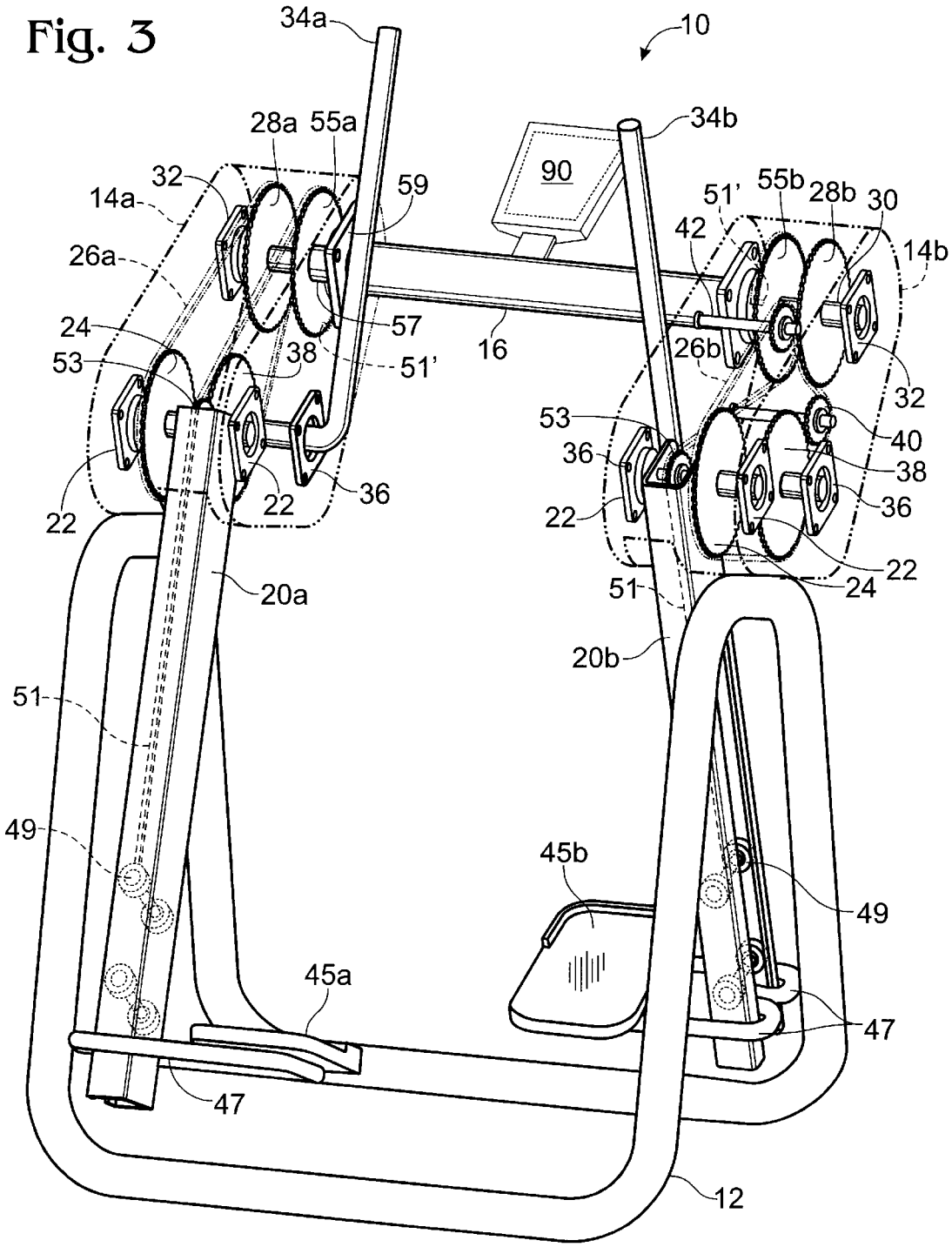
FIG. 3 is a cut-away perspective view of the exercise apparatus of FIG. 1, showing the internal motion translation mechanism.

An exercise apparatus according to one embodiment of the present invention is shown in FIG. 1, and generally indicated at 10. Exercise apparatus 10 includes a frame 12 that supports left housing 14*a* and right housing 14*b* in a stable fashion on an underlying floor surface. Housings 14*a* and 14*b* are connected together by a hollow shaft housing 16. FIGS. 2 and 3 show a left pedal guide 20*a* and a right pedal guide 20*b* on which pedals 45*a* and 45*b* are mounted via respective roller assemblies 49 and pedal support assemblies 47. Each pedal guide is pivotally mounted at an upper end to the housing 14*a* and 14*b*, and is supported by bearings 22, which attach to the respective housing. The user may drive the pedals in any one of the following ways:

(1) along an accurate path as the pedal guide pivots;

(2) in a radial direction along the length of each pedal guide; and (3) simultaneously pivotally and radially.

The left and right pedal guides and their corresponding roller assemblies are reciprocally linked by a motion translation mechanism 11. The motion translation mechanism includes a pivot translation linkage 13 configured to link the pivot motion of the left and right pedal guides reciprocally. Motion translation mechanism 11 further includes a radial motion translation linkage 15 configured to link the motion of the left and right pedals reciprocally in the radial direction along the length of each pedal guide.

Figure 4:
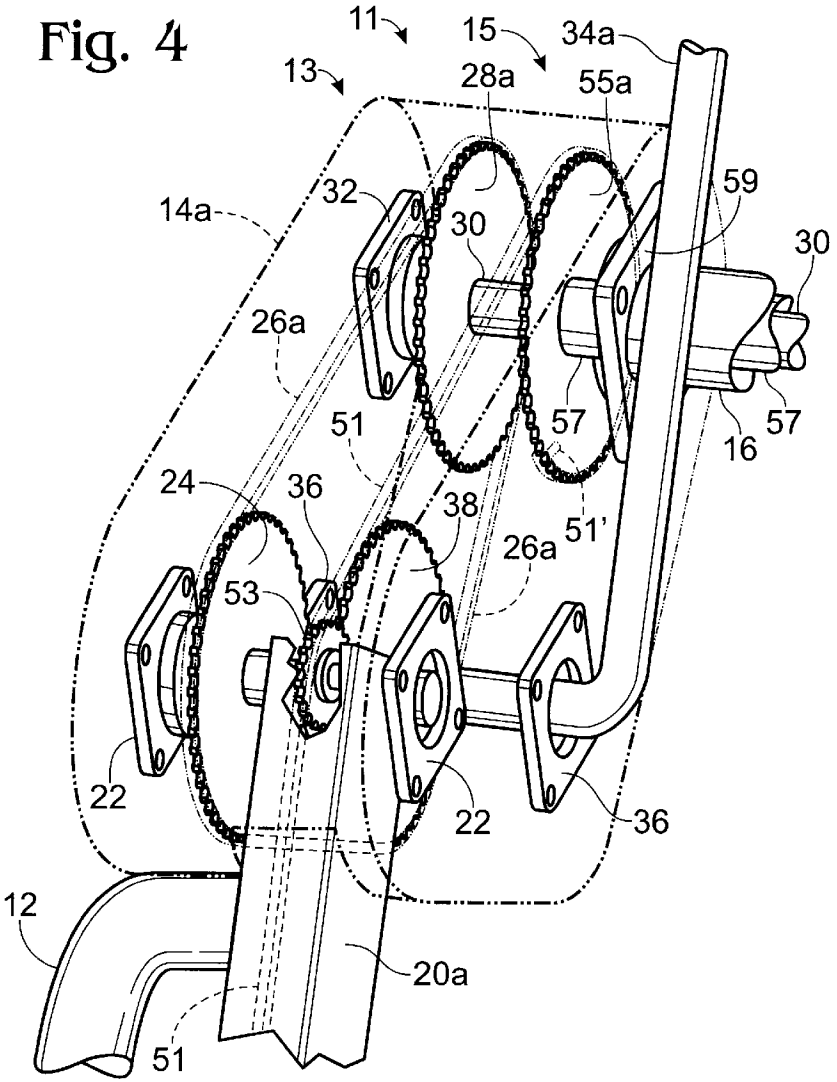
FIG. 4 is a partial cut-away perspective view of components of the motion translation mechanism of FIG. 3 housed in a left housing.

As shown in FIG. 4, pivot motion translation linkage 13 typically includes, on the left side of the apparatus, sprockets 24, 38, and 28*a* linked by a chain 26*a*, which work in tandem to rotate shaft 30 as the pedal guide 20*a* is pivoted forward or backward. Sprockets 24 are typically referred to as pivot sprockets, sprockets 38 may be referred to as handle sprockets, and sprockets 28*a* and 28*b* may be referred to as pivot translation sprockets. Chains 26*a*, 26*b* are also referred to as pivot chains.

Figure 5:
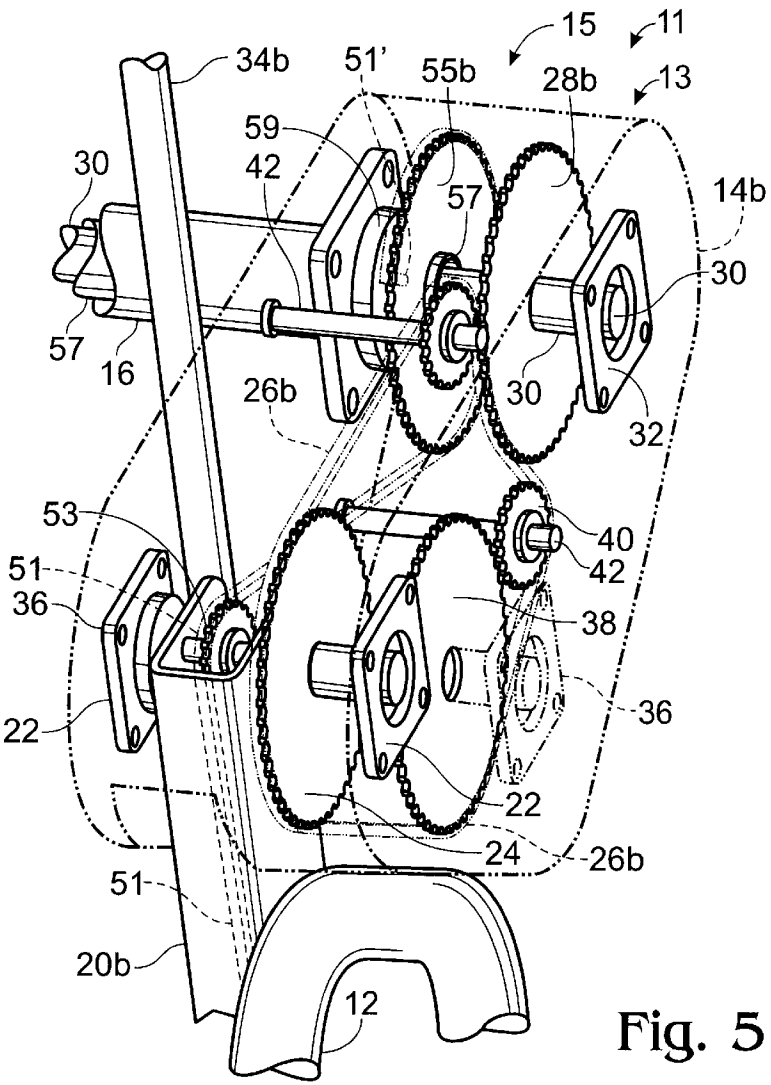
FIG. 5 is a partial cut-away perspective view of components of the motion translation mechanism of FIG. 3 housed in a right housing.

On the right side of the apparatus, as shown in FIG. 5, pivot motion translation linkage 13 further includes sprockets 28*b*, 24, and 38, as well as idler sprockets 40, all linked by a chain 26*b*. The idler sprockets 40 serve to reverse the direction of the rotation of sprocket 28*b*. As pedal guide 20*a* is pivoted forward, for example, the pivoting motion is translated through the chain 26*a*, pivot translation shaft 30, and chain 26*b*, which causes pedal guide 20*b* to rotate in the opposite direction. The chains 26*a* and 26*b* typically remains taut, so that no backlash or slack occurs and motion is smoothly translated between the pedals. Chains 26*a* and 26*b* may also be referred to as flexible tension members. While chains and sprockets are typically used, it will be appreciated that belts/cables and pulleys, cams, four bar linkages, or other suitable components may alternatively be used. As used herein the term "sprocket" should be understood to include both toothed sprockets and sprockets without teeth, more commonly referred to as pulleys.

The radial motion translation linkage typically includes, on the left side of the apparatus, a left pedal linkage having a chain 51 and an idler sprocket 53. The chain 51 is attached at a lower end to a roller assembly 49, which in turn is linked to a pedal support assembly 47 and pedal 45*a*. The radial motion translation linkage further includes a left-side radial motion translation sprocket 55*a*, which chain 51 engages. An end 51' of the chain 51 is fixedly inset into radial motion translation sprocket 55*a*. On the right side of the apparatus, like the left side, the radial motion translation linkage typically includes a right pedal linkage having a chain 51 and an idler sprocket 53. The radial motion translation linkage further includes a right-side radial motion translation sprocket 55*b*.

The motion of sprockets 55*a* and 55*b* is linked by a radial motion translation shaft 57. Typically pivot shaft 30 is positioned within radial motion translation shaft 57, although other configurations are possible. An end 51' of right-side chain 51 is fixedly inset into sprocket 55*b*, and the other end is attached to the roller assembly 49 coupled to pedal 45*b*. In operation, as pedal 45*a* is raised or lowered radially along pedal guide 20*a*, the radial motion of the pedal 45*a* is translated through left-side chain 51, idler sprockets 53 and sprocket 55*a*, through shaft 57, and again through sprockets 55*b* and right-side chain 51 and idler sprocket 53, such that pedal 45*b* moves radially along pedal guide 20*b*, in the opposite direction (i.e. reciprocally) to pedal 45*a*.

Thus, it will be appreciated that sprockets 24 are rigidly attached to pedal guides 20*a* and 20*b*. As shown in more detail in FIGS. 4, 5, to couple the pivot motion of pedal guide 20*a* and 20*b*, sprocket 28*a* in left housing 14*a* and sprocket 28*b* in right housing 14*b* are connected together by an inner shaft 30 that runs concentrically inside hollow shaft housing 16. The shaft 30 is supported at two ends by bearings 32, which are also attached to the respective housing.

To provide upper body exercise, handles 34*a*, 34*b* are provided. The handles 34*a*, 34*b* are generally sized for the grip of a user and are pivotally mounted at a lower end to the housing 14*a* and 14*b* by bearings 36. Sprockets 38 are also rigidly mounted to the handles on the lower horizontal portion of each handle. In the left housing 14*a*, chain 26*a* loops around and tensionally encompasses sprocket 24, sprocket 28*a* and sprocket 38 such that when left pedal guide 20*a* pivots, it will also turn left handle 34*a* and shaft 30. In the right housing 14*b*, chain 26*b* wraps around idler sprockets 40, which are attached to the housing 14*b* by mounting bolts 42. The path of chain 26*b* causes sprocket 28*b* to rotate in the reverse direction of sprockets 24 and 38. To achieve the reciprocal pivotal motion of pedal guide 20*a* and 20*b*, chain 26*b* loops around pedal guide sprocket 24, handle sprocket 38, idler sprockets 40 and to the inner side of sprocket 28*b*. When right pedal guide 20*b* pivots, it also turns right handle 34*b* and reversibly rotates shaft 30 such that left pedal guide 20*a* and left handle 30*a* will pivot in the opposite direction.

As described briefly above, exercise apparatus 10 also includes left foot pedal 45*a* and right foot pedal 45*b*. Each foot pedal is connected to the respective pedal guide by pedal support assembly 47. Pedal support assembly 47 typically includes a roller assembly 49 configured to support and allow the foot pedal to slide radially along the length of the pedal guide. Chain 51 connects at one end to the roller assembly 49, and extends generally upward along the inside of the pedal guide, and wraps around idlers 53 which are mounted to the upper end of the pedal guide 20*a* and 20*b*. To couple the radial motion of pedal 45*a* and 45*b*, sprocket 55*a* in left housing 14*a* and sprocket 55*b* in right housing 14*b* are connected together by a hollow shaft 57. Hollow shaft 57 is supported at two ends by bearings 59 and runs preferably but not necessarily concentrically inside shaft housing 16. Hollow shaft 57 is also configured such that it allows the smaller pivot motion connecting shaft 30 to run concentrically inside of it. To achieve the reciprocal radial motion of the left pedal 45*a* and right pedal 45*b*, chain 51 wraps around sprocket 55*a* in a clockwise direction and wraps around sprocket 55*b* in a counter-clockwise direction. When one foot pedal is pushed down, the other one will be pulled up along the pedal guide.

Figure 6:
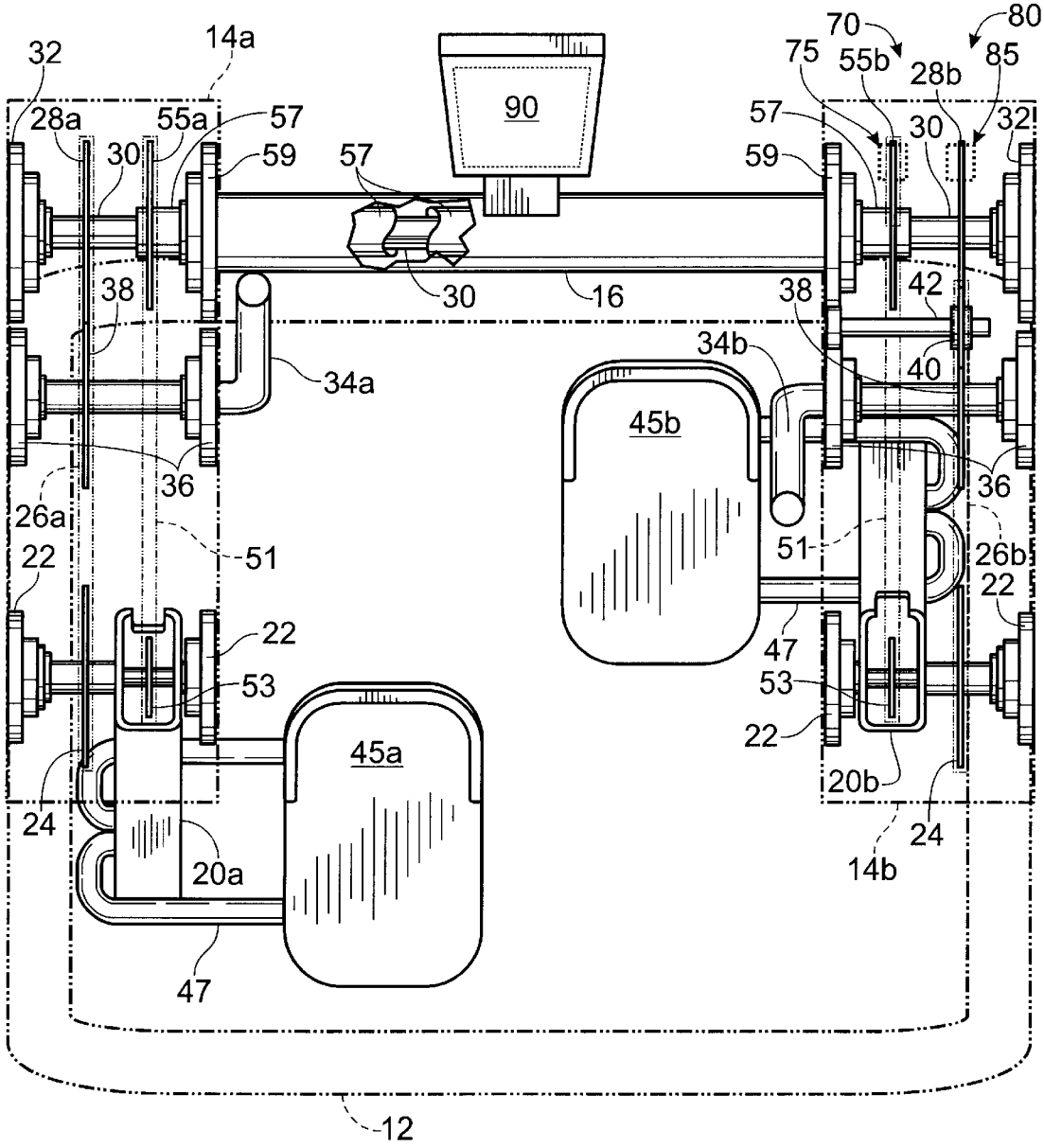
FIG. 6 is a cut-away top view of the exercise apparatus of FIG. 1.

Radial resistance subsystem 70 typically includes caliper disc brake 75, as shown in FIG. 6. Caliper disc brake 75 is mounted to the housing 14*b* and selectively applies friction force to sprocket 55*b*. Pivotal resistance subsystem 80 typically includes caliper disc brake 85. Caliper disc brake 85 is attached to housing 14*b* and selectively applies friction to sprocket 28*b*. Control console 90 typically includes readouts, keypad and controllers to control radial resistance subsystem 70 and pivotal resistance subsystem 80.

While the present invention has been particularly shown and described with reference to the foregoing preferred embodiments, those skilled in the art will understand that many variations may be made therein without departing from the spirit and scope of the invention. For example, the interconnecting chain, sprocket and shaft assemblies could be replaced by cable, pulley, belt, cam, gear, four bar linkage etc. Accordingly, the scope of the present invention should be limited only to the extent of the claims as follow.

I claim:

1. An exercise apparatus, comprising:

a frame;

left and right pedal guides, each pedal guide being pivotally mounted at an upper end to a pivot point on the frame and adapted to extend generally downward from the pivot point; and left and right pedals mounted transverse to the left and right pedal guides, respectively, each pedal extending inward toward the other to support a corresponding left or right foot of a user during exercise;

wherein the pedals are configured to slide in a radial direction along the pedal guides, and wherein the pedal guides are configured to pivot forward and backward relative to the user, such that the user may drive the pedals in any one of the following ways:

(1) along an accurate path as the pedal guide pivots;

(2) in a radial direction along the length of each pedal guide; and (3) simultaneously pivotally and radially.

2. The exercise apparatus of claim 1, wherein the left and right pedals are each mounted to a respective roller assembly, each roller assembly being coupled with a respective pedal guide and configured to enable each pedal to move in a radial direction along the length of the pedal guide.

3. The exercise apparatus of claim 2, wherein the left and right pedal guides and their corresponding roller assemblies are reciprocally linked by a motion translation mechanism.

4. The exercise apparatus of claim 3, wherein the motion translation mechanism includes:

a radial motion translation linkage configured to link the motion of the left and right pedals reciprocally in the radial direction along the length of each pedal guide; and a pivot translation linkage configured to link the pivot motion of the left and right pedal guides reciprocally.

5. The exercise apparatus of claim 4, wherein the radial motion translation linkage includes:

a left and right pedal linkage, each having a flexible tensile member connected to a corresponding roller assembly;

a left and right radial motion translation sprocket, each engaging a respective one of the left and right pedal linkages; and a radial motion translation shaft interconnecting the left and right radial motion translation sprockets for coupled rotation.

6. The exercise apparatus of claim 5, wherein the pivot translation linkage includes:

left and right pivot sprockets, each rotatably coupled with a respective left or right pedal guide;

left and right pivot translation sprockets;

left and right handle sprockets;

left and right pivot chains interconnecting the respective pivot sprockets with the respective pivot translation sprockets and handle sprockets such that motion of all the sprockets are linked; and a pivot translation shaft interconnecting the left and right pivot translation sprockets for coupled rotation.

7. The exercise apparatus of claim 6, wherein the radial motion translation shaft and the pivot translation shaft are concentric.

8. The exercise apparatus of claim 7, wherein the radial motion translation shaft is larger in diameter than the pivot translation shaft.

9. The exercise apparatus of claim 7, wherein the pivot translation shaft is larger in diameter than the radial motion translation shaft.

10. The exercise apparatus of claim 6, further comprising, left and right handles coupled with the left and right handle sprockets, respectively, and configured to move through an arc as the respective handle sprockets rotate.

11. An exercise apparatus, comprising:

a frame;

left and right pedal guides pivotally mounted to the frame, and providing a space for a user therebetween;

left and right pedals slidably mounted transverse to the left and right pedal guides, respectively; and a motion translation mechanism configured to link the pedals to move reciprocally; wherein said pedal guides are configured to pivot forward and backwards relative to the user.

12. The exercise apparatus of claim 11, further comprising, a support assembly mounted to the frame.

13. The exercise apparatus of claim 12, further comprising left and right roller assemblies mounted within each pedal guide and configured to travel along the length of the pedal guide.

14. The exercise apparatus of claim 13, further comprising left and right handles coupled with the support assembly.

15. The exercise apparatus of claim 14, wherein the motion translation mechanism includes:

a radial motion translation linkage configured to link the motion of the left and right pedals reciprocally in the radial direction along the length of each pedal guide; and a pivot translation linkage configured to link the pivot motion of the left and right pedal guides reciprocally.

16. The exercise apparatus of claim 15, wherein the radial motion translation linkage further includes:

left and right pedal linkages, each having a flexible tensile member connected to each roller assembly;

a left and right radial motion translation sprocket engaging each of the left and right pedal linkages; and a radial motion translation shaft interconnecting the left and right radial motion translation sprockets for coupled rotation.

17. The exercise apparatus of claim 16, wherein the pivot translation linkage further includes:

left and right pivot sprockets rotatably coupled with respective left and right pedal guides;

left and right pivot translation sprockets;

left and right handle sprockets;

left and right pivot chains interconnecting the respective pivot sprockets with the respective pivot translation sprockets and handle sprockets such that motion of all the sprockets are linked; and a pivot translation shaft interconnecting the left and right pivot translation sprockets for coupled rotation.

18. The exercise apparatus of claim 17, wherein the radial motion translation shaft and the pivot translation shaft are concentric.

19. The exercise apparatus of claim 18, wherein the radial motion translation shaft is larger in diameter than the pivot translation shaft.

20. The exercise apparatus of claim 18, wherein the pivot translation shaft is larger in diameter than the radial motion translation shaft.

* * * * *